United States Patent [19]

Clark

[11] 3,930,911

[45] Jan. 6, 1976

[54] BLASTING COMPOSITION AND METHOD OF MAKING SAME

[76] Inventor: Jared W. Clark, 1604 Loudon Heights Road, Charleston, W. Va. 25314

[22] Filed: Mar. 5, 1974

[21] Appl. No.: 448,207

[52] U.S. Cl. ..... 149/46; 149/61

[51] Int. Cl.[2] ..... C06B 31/28

[58] Field of Search ..... 149/46, 60, 61

[56] References Cited

UNITED STATES PATENTS

| | | | |
|---|---|---|---|
| 3,522,117 | 7/1970 | Atadan et al. | 149/46 X |
| 3,706,607 | 12/1972 | Chrisp | 149/46 X |
| 3,770,522 | 11/1973 | Tomic | 149/46 X |
| 3,779,821 | 12/1973 | Fujiki et al. | 149/46 X |

*Primary Examiner*—Stephen J. Lechert, Jr.

[57] ABSTRACT

Improved blasting compositions are prepared by the addition of a solution of an oil-soluble organic acid in fuel oil to prilled ammonium nitrate, followed by the addition of water, in controlled amounts, and ammonia, as an aqueous solution or in gaseous form, and mixing the resultant mixture until the density of the final product exceeds the density of water.

16 Claims, No Drawings

BLASTING COMPOSITION AND METHOD OF MAKING SAME

BACKGROUND OF THE INVENTION

The present invention relates to blasting compositions and it is particularly related to improved ANFO-based blasting compositions. More specifically, this invention is concerned with improved blasting compositions obtained by the addition of a solution of an oil-soluble organic acid in fuel oil to prilled ammonium nitrate, followed by the addition of water, in controlled amounts, and ammonia, as an aqueous solution or in gaseous form, and to a method of making such improved blasting compositions.

THE PRIOR ART

In my U.S. Pat. No. 3,764,421, issued Oct. 9, 1973, I have briefly described the history of explosive compositions, and the relatively recent replacement of conventional explosives (dynamite) with ANFO-based blasting compositions. The principal reason for this replacement is the superior explosive characteristics of ANFO (mixture of ammonium nitrate and fuel oil) and its considerably lower cost. However, as I have pointed out in my aforesaid patent, the ANFO-based blasting compositions suffer from some disadvantages which could limit their practical applications in blasting operations. These limitations, however, could be overcome by providing improved ANFO-based blasting compositions in accordance with the method described in my aforesaid patent.

While the improved ANFO-based blasting compositions described in my aforesaid patent represent considerable advance over the hitherto known ANFO-based blasting compositions, I have now discovered that they, too, have some disadvantages. Thus, I have found that the ANFO-based blasting compositions described in my aforesaid patent tend to undergo some caking and liquid phase separation after prolonged storage at elevated temperatures. While these phenomena have no significant adverse effect upon the detonating characteristics of these blasting compositions, and they are not usually encountered under field-mixing conditions, where prolonged storage time is not required, they are nevertheless somewhat objectionable and may present difficulties in material handling. Another problem is that ammonium nitrate, as supplied by various manufacturers, or even by the same manufacturer, vary from hard, dense prills to highly porous, soft prills. When using the method described in my aforesaid patent, the hard, dense prills can only be processed with difficulty, while the highly porous, soft prills tend to break down to finely divided solids early during the initial mixing operation.

SUMMARY OF THE INVENTION

Improved blasting compositions are provided which have the superior detonating characteristics of the ANFO-based blasting compositions described in my aforesaid patent and have considerably reduced tendency toward caking and liquid phase separation, particularly after prolonged storage at elevated temperatures. The improved blasting compositions of this invention are prepared by the addition of a solution of an organic acid and fuel oil to prilled ammonium nitrate, followed by the addition of water, in controlled amounts, and ammonia, as an aqueous solution or in gaseous form, and mixing the resultant mixture until the density of the final product exceeds the density of water.

DETAILED DESCRIPTION OF THE INVENTION

I have now discovered that the caking and liquid phase separation associated with the ANFO-based blasting compositions described in my aforesaid patent can be virtually eliminated by certain modifications in their basic compositions, as well as by certain modifications in the process of their preparation. Thus, I have now unexpectedly discovered that by introducing an oil-soluble organic acid and ammonia into the basic ANFO-based blasting compositions, caking and liquid phase separation can be virtually eliminated, without adversely affecting the detonating characteristics of the resultant blasting compositions. I have further discovered that the method of this invention can be employed to facilitate accomodation of the large variations in physical properties of the prilled ammonium nitrates which are generally available on the market.

The method of preparation of the blasting compositions of this invention is generally as described in my aforesaid patent, with certain modifications which will become evident from the ensuing description. Thus, a solution of an organic acid in fuel oil is thoroughly blended with ammonium nitrate, using suitably designed conventional mixers, until the organic acid-fuel oil solution has substantially completely penetrated the ammonium nitrate prills as evidenced by absence of oil film from the surface of the ammonium nitrate prills. Water, in a specified amount, is then added to the contents of the mixer and the resultant mixture is thoroughly blended to effect break-down of the ammonium nitrate prills into finely divided particles.

The aforesaid blending operation is carried out until the density of the resultant composition exceeds the density of 1.0 for water, and is preferably within the range of from about 1.1 to about 1.4. This may be accomplished by periodic withdrawal of samples of the materials in the mixer and measuring their density until a product is obtained which has the desired density.

Thereafter, a specified amount of ammonia is added to the contents of the mixer and the resultant mixture is once again thoroughly blended until the resulting product has a substantially uniform consistency.

The organic acids which are suitable for the preparation of the novel compositions of this invention include the saturated fatty acids which contain from about 8 to about 20 carbon atoms, preferably from about 12 to about 18 carbon atoms. Among the aforesaid organic acids, the carboxylic acids are preferred to the other organic acids, such as the sulfonic acids, etc.

The unsaturated acids corresponding to the aforesaid saturated fatty acids may also be employed for the purpose of this invention. Thus, the aforesaid saturated fatty acids may be employed individually, or as mixtures of said saturated and/or unsaturated fatty acids. The saturated fatty acids, however, are preferred, and more improved blasting compositions are obtained by using one more of these acids.

Exemplary saturated fatty acids which can be efficaciously employed herein are Caprylic, Pelargonic, Capric, Undecanoic, Lauric, Tridecanoic, Myristic, Pentadecanoic, Palmitic, Margaric, stearic (including its isomer, i.e., iso-stearic), Coconut oil, Nondecanoic and Arachidic acid, or mixtures thereof. Coconut oil acids and iso-stearic acid are most preferred for the purpose of this invention.

The aforesaid acids are generally employed in relatively minor amounts. Thus, the amount of these acids can vary from about 0.1 to about 10 weight per cent, preferably from about 0.1 to about 3.0 weight per cent based on the weight of final product.

The fuel oil employed in the practice of this invention is preferably diesel number 2 fuel oil, well known to those skilled in the art. However, if desired, the fuel oil may be partly or totally replaced with other oxidizeable materials such as hydrocarbon fractions derived from petroleum and similar fractions derived from other fossil fuels. Oils derived from plant and animal origins, and synthetic products such as alcohols, glycols, amines, esters and ketones may also be used in lieu of fuel oil. Also, if desired, the fuel oil may be partly or totally replaced by the aforesaid saturated oil-soluble acids.

The amount of fuel oil employed in the practice of this invention constitutes from about 3 to about 6 weight per cent, based on the final product.

Part of the ammonium nitrate (up to about 30%) may be replaced with other nitrates such as sodium nitrate, potassium nitrate and calcium nitrate. The quantity of ammonium nitrate (or total nitrates, if ammonium nitrate is partially replaced with other nitrates) used can vary from about 80 to about 94 weight per cent, preferably from about 86 to about 92 weight per cent based on the final product. If desired, the nitrates may be employed, at least in part, as aqueous solutions to facilitate the blending operation.

The amount of water which is added is usually from about 1 to about 9 weight per cent, and is preferably from about 1 to about 4 weight per cent based on the weight of the final product. This amount includes water added to the system in other forms, such as where the ammonia, ammonium nitrate and the other inorganic nitrates are used as aqueous solutions.

The amount of ammonia which can be added can vary from about 0.5 to about 1.5 moles per mole of the organic acid or acids.

In the preparation of the novel compositions of this invention, a critical relation with respect to oxygen balance must be maintained between the carbonaceous and other oxidizeable materials, on the one hand, and ammonium nitrate (or total nitrates) on the other hand. If the amount of the carbonaceous and other oxidizeable materials is less than the amount required to maintain the critical balance, the amount which is available to combine with the oxygen in the ammonium nitrate (or total nitrates) will be insufficient, hence resulting in a reduction of the explosive energy available in a balanced composition. In addition, the detonation of such compositions promotes the formation of nitrogen peroxide which is toxic and undesirable. If, on the other hand, the amount of carbonaceous and oxidizeable materials exceeds the critical balance, i.e., there is an excess of such material over the amount required to combine with the available oxygen, the resulting composition will be less sensitive to detonation.

The present invention will now be illustrated by the following examples.

EXAMPLE 1

Four hundred pounds of low-density, fertilizer-grade, prilled ammonium nitrate and a solution of 4.4 pounds coconut oil fatty acids (Ashland Oil Company Hydrofol Acid 631) in 20 pounds of number 2 diesel fuel oil, were charged to a rotary-drum, cement-type mixer, and mixed for 2 hours. The mixture was allowed to stand in the mixer for 2 days without agitation, at a temperature of about 30° F. After this period, the solution of coconut oil fatty acids in the diesel fuel had substantially completely penetrated into the ammonium nitrate prills.

An aqueous solution of ammonia (containing 3.1 weight per cent ammonia) was then added to the content of the mixer, and the mixture was continuously agitated for 10 minutes until a weak odor of ammonia could be detected, indicating that the amount of ammonia which has been added is in excess of that required to combine with the acid. The resulting mixture was charged to multi-wall paper bags, each containing 50 pounds of this product, and these bags were stored in a van-body trailer at ambient conditions of from about 20°–60° F., for 13 days. Thereafter, the contents of the bags were charged back into the rotary-drum mixer and mixed thoroughly for approximately two hours.

The resultant product was light pink in color and had the following composition:

| Compound | Amount, pounds | Weight % |
|---|---|---|
| Ammonium nitrate | 400.0 | 85.9 |
| Number 2 diesel fuel oil | 20.0 | 4.3 |
| Coconut oil fatty acids | 4.4 | 0.9 |
| Water | 40.0 | 8.6 |
| Ammonia | 1.3 | 0.3 |
| Red dye* | 4 grams | — |
| Total | 465.7 | 100.0 |

*The dye is generally added to the number 2 diesel fuel oil.

The contents of the rotary drum were bagged into 5½ inch diameter, double, polyethylene bags, each containing 25 pounds of this material. These bags were stored in a van-type, uninsulated truck body for approximately 1 year. No caking or liquid phase separation was observed during the months of January through June. Only slight caking of the product and small amounts of liquid phase separation were observed during July and August. The caked product could be readily broken up by hand. The density of the product obtained in this example was 1.1 (as compared to density of 1.0 for water) and could be increased to 1.3 by tapping.

Sensitivity tests were conducted on the product of this example, following the procedure set forth in the examples of my aforesaid patent, which procedure is incorporated herein by reference. It was determined that the product of this example could not be detonated with a number 8 commercial blasting cap when confined in an open-top, 12-ounce, tin-plate can. However, detonation was observed with a 16-inch piece of 100 grain Primacord (trade name for a detonating fuse manufactured by the Ensign Bickford Company) loop placed in the can with 400 grams of the lightly-packed mixture.

EXAMPLE 2

A solution of 33 pounds coconut oil fatty acid (Ashland Oil Company Hydrofol Acid 631) in 150 pounds number 2 diesel fuel oil (containing small amount of red dye) was added to 3,000 pounds of low-density prilled ammonium nitrate in a rotating-drum, cement-type mixer and the mixture was thoroughly blended therein for one hour to insure substantially complete penetration of the acid solution into the ammonium nitrate. The resulting pink mixture was allowed to stand overnight at ambient temperature of about 30° F. after which an aqueous solution of ammonia (consisting of 10 pounds ammonia in 126 pounds of water) was added to the mixer and, after mixing for three hours, the mixture was again allowed to stand overnight at ambient temperature of about 30° F. The resulting mixture was again mixed the following day for an additional hour to insure complete break-down of the prills into finely divided particles. The composition of the resultant product was as follows:

| Compound | Amount, pounds | Weight % |
|---|---|---|
| Ammonium nitrate | 3,000 | 90.4 |
| Number 2 diesel fuel oil | 150 | 4.5 |
| Coconut oil fatty acids | 33 | 1.0 |
| Water | 126 | 3.8 |
| Ammonia | 10 | 0.3 |
| Total | 3,319 | 100.0 |

The density of the resultant product was 1.1 (compared to a density of 1.0 for water). Sensitivity tests conducted as in Example 1, supra, indicated that the resulting composition could not be detonated with number 8 blasting cap or with a 50-grain Primacord loop, but could be detonated with 100-grain, 150-grain and 200-grain Primacord loops.

EXAMPLE 3

Three thousand pounds of low-density, prilled ammonium nitrate, and a solution of 33 pounds coconut oil fatty acid (Emery Industries, Inc., Emery 624 stripped coconut fatty acid) in 150 pounds of number 2 diesel fuel oil (containing a small amount of red dye) were charged to a rotary-drum, cement-type mixer and mixed for 1 hour. The resultant mixture was allowed to stand overnight at ambient temperature of about 40° F. during which time the fatty acid-fuel oil solution had substantially completely penetrated and impregnated the ammonium nitrate. Eighty pounds of water was then added to the contents of the mixture and mixing was continued for an additional 3 hours. The resultant mixture was again allowed to stand overnight in the mixer at ambient temperature of about 40° F. Two gallons of an aqueous solution of ammonia (containing 5 pounds ammonia) was then added to the mixture and mixing continued for an additional 3 hours. The resultant product had a density of 1.1, could not be detonated with number 8 blasting cap and had the following composition:

| Compound | Amount, pounds | Weight % |
|---|---|---|
| Ammonium nitrate | 3,000 | 91.5 |
| Number 2 diesel fuel oil | 150 | 4.6 |
| Coconut oil fatty acids | 33 | 1.0 |
| Water | 91 | 2.8 |
| Ammonia | 3.5 | 0.1 |
| Total | 3,277.5 | 100.0 |

EXAMPLE 4

Three thousand pounds of low-density, prilled ammonium nitrate and a solution of 33 pounds iso-stearic acid (Emery Industries, Inc., number 871) in 150 pounds number 2 diesel fuel oil (containing a small amount of red dye) were charged to a rotary-drum, cement-type mixing unit. After mixing for 2 hours, the iso-stearic acid-fuel oil solution had substantially completely penetrated and impregnated the ammonium nitrate. After standing overnight at an ambient temperature of about 50° F., 80 pounds of water was added and mixing continued for an additional 2 hour period. The resultant mixture was allowed to stand for 13 days at ambient temperatures of about 40°–60° F., and thereafter transferred to a paddle-blade mixer. Two gallons of aqueous solution of ammonia (containing 3.5 pounds of ammonia) was then added to the paddle-blade mixer and the mixture was thoroughly blended for an additional 2 hour period.

The resultant product had a density of 1.2 (compared to a density of 1.0 for water) and had the following composition:

| Compound | Amount, pounds | Weight % |
|---|---|---|
| Ammonium nitrate | 3,000 | 91.5 |
| Number 2 diesel fuel oil | 150 | 4.6 |
| Iso-stearic acid | 33 | 1.0 |
| Water | 91 | 2.8 |
| Ammonia | 3.5 | 0.1 |
| Total | 3,277.5 | 100.0 |

The resultant product could not be detonated with a number 8 blasting cap. A weak, partial detonation was observed with a 50-grain Primacord loop and complete detonation was observed with 100-grain, 150-grain and 200-grain Primacord loops.

It is evident from the foregoing description and examples that certain modifications may be made, both in the compositions of this invention, as well as in the method of their preparation, without departing from the scope of this invention. For example, by using a paddle-type mixer or other suitably designed mixer, it is possible to charge all the ingredients into the mixer substantially simultaneously, and then mixing these ingredients thoroughly until a product having the desired consistency and density is obtained. Also, as is evident from the examples, the ingredients can be added sequentially with the acidfuel oil solution being first mixed with the ammonium nitrate, followed by the addition of ammonia and water, consecutively, with intermittent mixing. Once again, the various ingredients are blended thoroughly until a product having the desired consistency and density is obtained. The sequence of addition of ammonia and water may be reversed if desired, although the most preferred sequence of operation contemplates first mixing the acid-fuel oil solution with ammonium nitrate, followed by the addition of water and finally, the addition of ammonia.

Other modifications in the process can be made which are obvious from the foregoing detailed description of this invention.

What is claimed is:

1. A non-emulsified blasting composition which consists essentially of a substantially uniform mixture of from about 80 to about 94 weight per cent ammonium nitrate, from about 3 to about 6 weight per cent oxidizeable carbonaceous material, from about 0.1 to about 10 weight per cent organic acid soluble in said carbonaceous material and having about 8 to about 20 carbon atoms, from about 1 to about 9 weight per cent water and from about 0.5 to about 1.5 moles of ammonia per mole of said organic acid, and wherein the density of the said blasting composition is greater than the density of water.

2. A composition as in claim 1 wherein at least part of the said ammonium nitrate is replaced with a compound selected from the group consisting of sodium nitrate, potassium nitrate, calcium nitrate and mixtures thereof.

3. A composition as in claim 1 wherein the said acid is a saturated fatty acid containing from about 8 to about 18 carbon atoms.

4. A composition as in claim 2 wherein the said acid is a saturated fatty acid containing from about 8 to about 18 carbon atoms.

5. A composition as in claim 1 wherein the said acid is selected from the group consisting of coconut oil fatty acid and iso-stearic acid.

6. A composition as in claim 2 wherein the said acid is selected from the group consisting of coconut oil fatty acid and iso-stearic acid.

7. A composition as in claim 1 wherein the amount of water is from about 1 to about 4 weight per cent.

8. A composition as in claim 2 wherein the amount of water is from about 1 to about 4 weight per cent.

9. A composition as in claim 3 wherein the amount of water is from about 1 to about 4 weight per cent.

10. A composition as in claim 4 wherein the amount of water is from about 1 to about 4 weight per cent.

11. A composition as in claim 5 wherein the amount of water is from about 1 to about 4 weight per cent.

12. A composition as in claim 6 wherein the amount of water is from about 1 to about 4 weight per cent.

13. A process for the preparation of a blasting composition which comprises mixing from about 80 to about 94 per cent ammonium nitrate with from about 0.1 to about 10 weight per cent acid, from about 3 to about 6 weight per cent oxidizeable carbonaceous material, from about 1 to about 9 weight per cent water and from about 0.5 to about 1.5 moles of ammonia per mole of said acid, wherein said acid contains from about 8 to about 20 carbon atoms and is soluble in said oxidizeable carbonaceous material, carrying on the mixing of said components until the resultant product attains a density greater than the density of water.

14. The process of claim 13 wherein at least a part of the ammonium nitrate is in the form of an aqueous solution.

15. The process of claim 13 wherein the said components are mixed until the resultant product attains a density of from about 1.1 to about 1.4.

16. The process of claim 14 wherein the said components are mixed until the resultant product attains a density of from about 1.1 to about 1.4.

* * * * *